US008562383B2

(12) United States Patent
Weiss

(10) Patent No.: US 8,562,383 B2
(45) Date of Patent: Oct. 22, 2013

(54) TOWING EQUIPMENT

(76) Inventor: Norman Weiss, Merano (IT)

( * ) Notice: Subject to any disclaimer, the term of this patent is extended or adjusted under 35 U.S.C. 154(b) by 225 days.

(21) Appl. No.: 12/978,291

(22) Filed: Dec. 23, 2010

(65) Prior Publication Data

US 2012/0037062 A1 Feb. 16, 2012

(30) Foreign Application Priority Data

Aug. 14, 2010 (IT) ..... VR2010A0169

(51) Int. Cl.
*B63B 35/85* (2006.01)
*B63B 21/04* (2006.01)

(52) U.S. Cl.
USPC ..... 441/69; 114/253

(58) Field of Classification Search
USPC ..... 114/242, 253; 441/65, 68, 69, 73; 280/292, 480; 440/33; 2/311
See application file for complete search history.

(56) References Cited

U.S. PATENT DOCUMENTS

| | | | | |
|---|---|---|---|---|
| 1,591,105 | A * | 7/1926 | Rolland | 280/480 |
| 2,920,598 | A * | 1/1960 | Nielsen | 114/253 |
| 2,943,591 | A | 7/1960 | Schneider | |
| 3,148,655 | A | 9/1964 | Brant | |
| 3,175,265 | A * | 3/1965 | Gunderson | 24/132 WL |
| 3,494,319 | A * | 2/1970 | Dunlap | 441/69 |
| 3,650,237 | A | 3/1972 | Hartman | |
| 4,279,062 | A * | 7/1981 | Boissonnet | 24/305 |
| 5,009,183 | A * | 4/1991 | Naypaver | 114/253 |
| 5,899,782 | A * | 5/1999 | Martin | 441/66 |
| 5,950,569 | A * | 9/1999 | Perrulli | 119/770 |
| 6,095,880 | A * | 8/2000 | Giunta | 441/69 |
| 6,991,502 | B2 * | 1/2006 | Haynes, Jr. | 441/69 |
| 7,438,653 | B2 * | 10/2008 | Anderson | 473/458 |

FOREIGN PATENT DOCUMENTS

| | | | |
|---|---|---|---|
| CA | 2195808 | A1 | 7/1998 |
| FR | 1511983 | A | 4/1968 |
| FR | 2250551 | A1 | 6/1975 |
| GB | 1221356 | A | 2/1971 |
| WO | 99/48754 | A1 | 9/1999 |

OTHER PUBLICATIONS

PCT International Search Report for PCT/EP2011/003456 filed on Nov. 7, 2011 in the name of Norman Weiss.
PCT Written Opinion for PCT/EP2011/003456 filed on Nov. 7, 2011 in the name of Norman Weiss.

* cited by examiner

*Primary Examiner* — Daniel V Venne
*Assistant Examiner* — Anthony Wiest
(74) *Attorney, Agent, or Firm* — Steinfl & Bruno LLP

(57) ABSTRACT

The present disclosure relates to a towing equipment for towing a person by a vehicle. The towing equipment comprises a proximal portion intended to be associated with said person, a distal portion intended to be connected to said vehicle, and a junction region interposed between the proximal portion and the distal portion. The proximal portion includes a first flexible branch and a second flexible branch, which are connected to the distal portion at the junction region. A proximal end of said first flexible branch comprises a handle; a proximal end of said second flexible branch is configured to be associated with the waist of said person. The present disclosure further relates to an abdominal belt intended to be used in conjunction with a towing equipment. The present disclosure also relates to a method for towing a person by a vehicle or the like. In particular, the person is a water skier and the vehicle is a motor boat.

24 Claims, 6 Drawing Sheets

TOWING EQUIPMENT

CROSS-REFERENCE TO RELATED APPLICATIONS

The present application claims the benefit of Italian Patent Application VR2010A000169 filed on Aug. 14, 2010, which is incorporated herein by reference in its entirety.

FIELD

The present disclosure generally refers to the towing equipment field. To be more specific, the present disclosure refers to a towing equipment for carrying out a towing of a person by a vehicle, a carrier or the like; even more specifically, it refers to a towing equipment for sports purposes, like, e.g. for towing a person during a sporting activity of water skiing or the like.

BACKGROUND

Considering the water skiing field, this sports discipline basically envisages that a person, which is provided with adequate skis, be towed by a motor boat through a rope and thereby move on a sea or lake surface. In this case the person is a skier.

In the known art, the water skiing rope has a first end that is provided with a handle held by the skier, and a second end that is fastened to the motor boat. The motor boat during its motion or run transmits a pulling force to the skier through the rope and the skier's hands, which firmly hold the handle. The skier gains and keeps a speed, corresponding to the motor boat speed, which allows him/her to skim on the water surface and perform evolutions or acrobatics. When the skier wants to stop, he/she releases the handle and therefore is no more dragged by the motor boat.

A drawback of the known art lies in the force required of the skier for holding the handle and in the great strain acting on the skier's arms. In fact, the arms transmit the entire towing force to the skier's body; therefore, above all during an initial acceleration stage, the skier's arms are subjected to remarkable pulling stresses.

This makes the approach to this sport quite difficult, as it requires remarkable fitness and basic physical strength; in addition, a beginner can easily get discouraged when facing the physical inability to hold the handle until reaching a sufficient speed.

Similar difficulties are also encountered by persons who, though already experienced in this sport, wish to resume activity after a long stop or whose age is greater: in these cases as well, the required strength and physical fitness might be excessive for a person who is no more trained or is weaker.

Another drawback of the known art is that the peculiar distribution of forces acting on the skier, i.e., a pulling force acting on the arms and an opposite resisting force acting on the feet, generates a torque which produces a remarkable strain to the skier's back in order to keep a correct skiing position. In fact, such forces are substantially equal in strength, though being opposite in direction, and act at opposite ends of the skiers body; in this condition, the torque acting on the skier is very high. Over time this can cause muscular strains, back pain or injuries, even more likely in the case of a poorly trained or weak person.

SUMMARY

The present disclosure moves from the position of the technical problem of providing a towing equipment for towing a person by a vehicle or the like, said towing equipment allowing to overcome at least one of the drawbacks mentioned above with reference to the known art and/or allowing to attain further advantages.

It should be taken into account that the drawbacks mentioned above with reference to the known art have been singled out by the inventor of what is described in the present disclosure; in fact, such drawbacks are not already known per se to the public. Therefore, the posing of the technical problem is part of the inventive activity realized by the inventor.

The solution to the technical problem can be obtained by providing a towing equipment comprising a first flexible branch to be associated with the hands of a person, a second flexible branch to be associated with the waist of said person, and a junction region between the flexible branches and a distal portion of the towing equipment; the distal portion is intended to be connected to a vehicle. The towing equipment is useful for towing said person by said vehicle.

The solution to the technical problem can also be obtained by a method comprising the steps of providing a towing equipment comprising a first flexible branch, a second flexible branch, and a junction region between the flexible branches and a distal portion of the towing equipment;

connecting said distal portion to a vehicle;

associating a proximal end of the second flexible branch with the waist of a person, setting up a connection between the waist of the person and the distal portion of the towing equipment; and associating a proximal end of the first flexible branch with the hands of the person.

Secondary features of the subject of the present disclosure are set forth in the corresponding dependent claims.

It should be noted that the towing equipment according to the present disclosure is specifically intended to be used for towing a person or skier during a sporting activity such as water skiing, where the skier is equipped with skis on the feet and is towed by a motor boat, a boat or a similar water vehicle along a water surface, like e.g. a lake or sea. However, it should be understood that the towing equipment according to the present disclosure may be used also in other water sports activities (e.g., kitesurfing) or non-water sports activities, e.g. for towing a skier on snow or on grass, or a skater on ice or on pavement, or in non-sports activities.

The towing vehicle is to be understood, generally, in a broad sense, i.e. as a means that, placed at a certain distance from the towed person, is able to provide a pulling or towing force acting on the person to set him/her in motion, accelerate and keep him/her in motion at a desired speed. For instance, the vehicle may be a motor boat in case of water skiing, a kite in case of kitesurfing, a snowmobile in case of snow skiing.

A towing vehicle suitable for the specific purpose will be selected on a case-by-case basis; such a selection is within the reach of a person skilled in the art and therefore lies outside the aim of the present disclosure.

Each between the first flexible branch and the second flexible branch is, e.g., made by a rope or plural ropes joined to each other.

According to some embodiments of the disclosure, the first flexible branch and the second flexible branch are joined to each other and are shaped as a continuous flexible body. In other words, the first flexible branch and the second flexible branch are (or comprise, in case they are made by plural ropes joined to each other) contiguous sections or segments of a same rope, line or the like, which is arranged around a return member near the distal region of the towing equipment (i.e., the region that is fastened to the vehicle). In this case, the proximal end of the first flexible branch and the proximal end of the second flexible branch are opposite ends of a single flexible body (in particular, of a single rope), arranged substantially in a C-like shape around the return member of the towing equipment.

According to some embodiments of the disclosure, such a continuous flexible body can slide on the return member (that, e.g., comprises a pulley or pivoted wheel), so that the lengthening of a flexible branch corresponds to the shortening of the other flexible branch, and vice versa. To be more specific, the return member includes a seat, where the continuous flexible body is mounted and can slide.

According to some embodiments of the disclosure, an automatic release device is provided, said automatic release device being able to interrupt the continuity of the first flexible branch or the second flexible branch; basically, said automatic release device "breaks up" the flexible branch, separating the proximal end from the distal end and interrupting the physical and functional continuity between them.

In other words, the automatic release device is configured to release a proximal end of the first flexible branch from a remaining part of the first flexible branch; in another embodiment, the automatic release device is configured to release a proximal end of the second flexible branch from a remaining part of the second flexible branch.

In particular, such automatic release device is useful to implement a safety system that, when the person releases the handle, disconnects the person from the distal region and therefore from the towing vehicle, so that the person be no more subjected to the towing. Therefore, when the person decides to release the handle or loses it, detachment from the towing vehicle occurs immediately and automatically.

According to some embodiments of the disclosure, the second flexible branch is associated with the waist of the person through an abdominal belt which can be fastened to the person.

In particular, the second flexible branch is associated with the abdominal belt through a connecting member which can slide along the abdominal belt. Therefore, the proximal end of the second flexible branch can move between one side (or hip) and the other side (or hip) of the person (and optionally even beyond, in the back region) during a rotation of the torso of the person.

For instance, a guide element is mounted on the abdominal belt: the guide element, which e.g. is a rope or the like fastened to the sides of the belt, extends in front of the belly and on the hips of the person (and, in case, behind the back as well), to form a sort of half-circle or annular portion. The connecting member, fastened to the second flexible branch, connects the second flexible branch to the abdominal belt; the connecting member is mounted on the guide element and can slide along the latter. An abdominal belt comprising said guide element is a subject of the present disclosure as well.

According to some embodiments of the disclosure, the connecting member comprises a pulley or a wheel; basically, it is a simple block which slides on the guide element.

Further features and the operation steps of the subject of the present disclosure will be made evident in the following detailed description of example embodiments thereof, given by way of example and not for limitative purposes.

BRIEF DESCRIPTION OF THE DRAWINGS

Reference will be made to the figures of the annexed drawings, wherein.

DESCRIPTION OF EXAMPLE EMBODIMENTS

Figure 1:
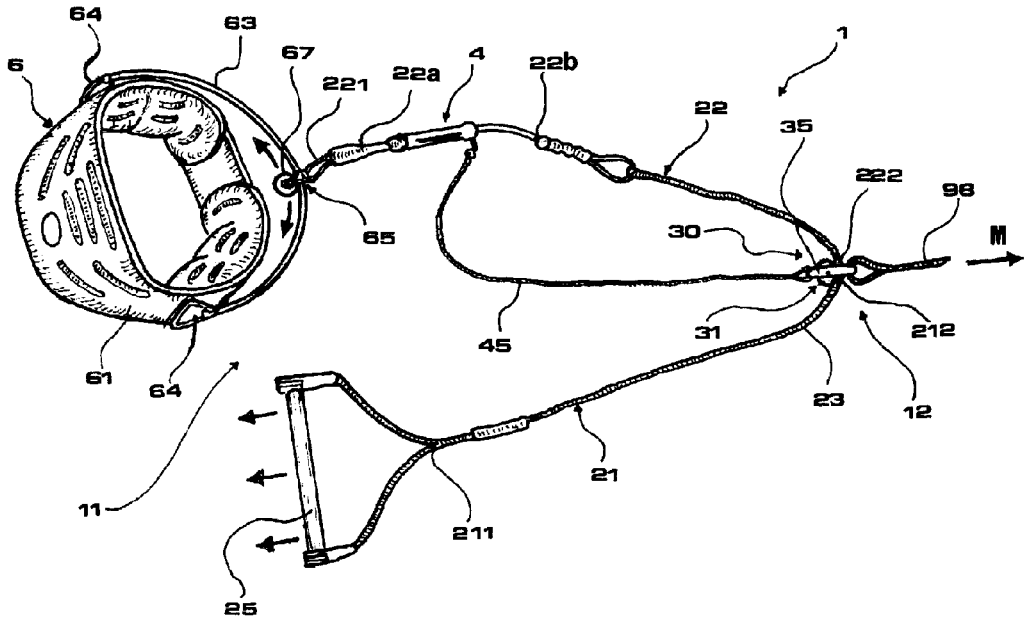
FIG. 1 shows a perspective view of a towing equipment comprising an abdominal belt, according to the present disclosure.

With reference to the annexed figures, an embodiment of a towing equipment for towing a person by a vehicle or a similar carrier is shown; the towing equipment is denoted by reference number 1.

To be more specific, the towing equipment 1 is intended for towing a person or skier 8 during a sporting activity such as water skiing, during which the skier 8, who is equipped with skis 80 on his/her feet, is towed by a motor boat 9, a boat or a similar water vehicle along a water surface 90, like, e.g. a lake or sea.

Figure 2:
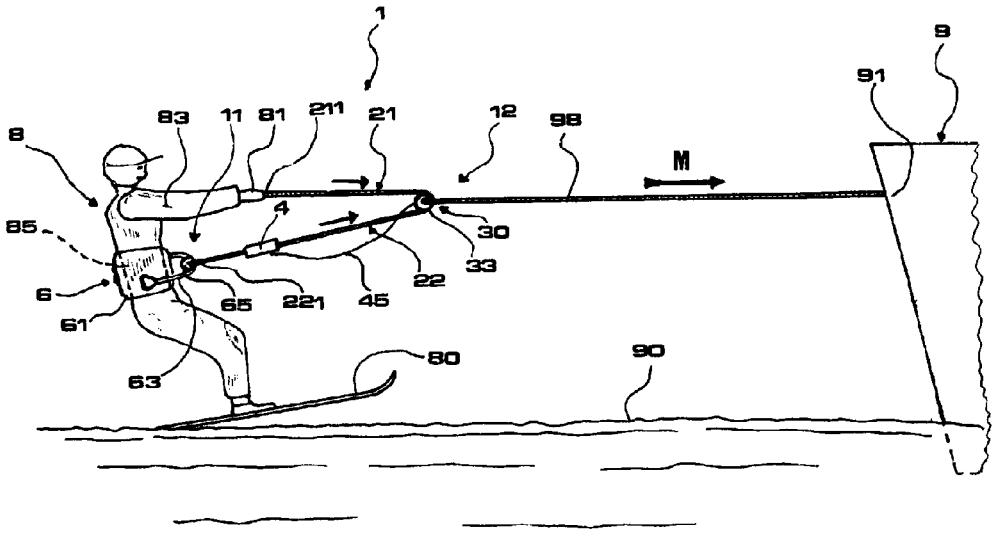
FIG. 2 shows a schematic side view of a towing equipment according to the present disclosure, when used by a person.

Hereinafter the present description will be carried out with specific reference to a water skier 8 towed by a motor boat 9 (FIG. 2 shows only the stern of the motor boat 9, the depiction of the entire motor boat 9 being unnecessary for the purposes of the present disclosure).

The towing equipment 1 has a proximal portion 11, which is the portion nearer to the person 8 when the towing equipment 1 is used, and a distal portion 12, which is the portion farther from the person 8 and nearer to the motor boat 9 when the towing equipment 1 is used. A junction region 30 is interposed between the proximal portion 11 and the distal portion 12.

The distal portion 12 is intended to be connected to the motor boat 9, e.g. the distal portion 12 includes a rope or line 98 which is fastened to the junction region 30 and to the motor boat 9 and extends between them. Alternatively, the distal portion 12 (or the junction region 30) can be directly mounted on the motor boat 9 or on a wall 91 of the latter. The proximal portion 11 is intended to be associated with the person 8, as described hereinafter.

Basically, the towing equipment 1 is interposed between the vehicle 9 and the person 8; therefore the towing equipment 1 transmits the force and the speed of the vehicle 9 to the person 8, causing the latter to accelerate and move.

The proximal portion 11 comprises a first flexible branch 21 and a second flexible branch 22; each of these flexible branches 21, 22 extends between the person 8 and the distal portion 12 of the towing equipment 1 and is connected to the distal portion 12 at the junction region 30.

Each flexible branch 21, 22 therefore has a respective proximal end 211, 221 at a proximal end of the towing equipment 1, and a respective distal end 212, 222 at the junction region 30 of the towing equipment 1.

Such flexible branches 21, 22 are made of ropes, lines, strips or the like. Each flexible branch 21, 22 comprises e.g. a rope, or plural ropes joined or knotted to each other, shaped as a flexible member which covers the distance between the person 8 and the junction region 30.

In the example, said ropes are of the type commonly adopted for water skiing; they are made of polypropylene, polyethylene, of Dyneema® or of Spectra®, with optional external coating of polyurethane.

For instance, a suitable rope of polypropylene or of polyethylene has a diameter of 8 mm; a suitable rope of Dyneema® or of Spectra® has a diameter of 4 mm; a suitable polyurethane sheath coating has a thickness of 1 mm (therefore adding 2 mm to the overall diameter of the rope).

For instance, the length L21 of the first flexible branch 21 is of 125 cm and the length L22 of the second flexible branch 22 is of 125 cm. The lengths of the two flexible branches 21, 22 can be different from each other in order to take into account the extension of the arms of the person 8.

Within the context of the present disclosure, the length of the first or second flexible branch 21, 22 is to be understood as a distance between the proximal end 211, 221 and the distal end 212, 222 of the flexible branch 21, 22 when the latter is taut.

The proximal end 211 of the first flexible branch 21 comprises a handle 25 or holding bar, which e.g. is made of iron coated with a rubber layer. In the example, the first flexible branch 21 has a bifurcation at the proximal end 211 and the opposite ends of the handle 25 (which, e.g., is a substantially cylindrical body) are fastened to the respective sections of said bifurcation, thereby making a triangle-shaped arrangement. In use, the handle 25 is intended to be grabbed and held with the hands 81 by the skier 8.

The proximal end 221 of the second flexible branch 22 is intended to be associated with the waist 85 or belt region of the skier 8. In particular, the proximal end 221 is fastened to the waist 85 of the skier 8 through an abdominal belt 6 or trapeze, an embodiment of which will be described below. Alternatively, the abdominal belt 6 may be part of a harness or of a garment such as trousers, a jacket or a suit.

The proximal end 221 of the second flexible branch 22 comprises a connecting member 65 for connection to the abdominal belt 6. In alternative embodiments, the connecting member 65 can be a snap hook or even a mere knot; lacking an abdominal belt, the proximal end 221 can be fastened to the waist 85 of the skier 8 by encircling the waist 85, for instance passing the rope of the second flexible branch 22 around the waist 85 and fastening it with a knot so as to make a band or ring that encircles or wraps round the waist 85.

Thus, the second flexible branch 22 is configured to be associated with the waist 85 of the skier 8.

It is evident that different modes are possible for associating the second flexible branch 22 (and in particular its proximal end 221) with the waist 85 of the skier 8; basically, it is required that a pulling force acting along the second flexible branch 22 be transmitted to the skier 8 in the region of the waist 85, causing a towing thereof in the direction of motion M.

When the skier 8 uses the towing equipment 1, the towing force acts on the skier 8 both at the hands 81/arms 83 (being exerted by the first flexible branch 21) and at the waist 85 or midriff region (being exerted by the second flexible branch 22), rather than only at the hands/arms as in the known art. In fact, the first flexible branch 21 sets up a connection between the hands 81 and the distal portion 12 of the towing equipment 1 that is connected to the towing vehicle 9, whereas the second flexible branch 22 sets up a connection between the waist 85 and the distal portion 12.

Therefore, the overall towing force is split up into the two flexible branches 21, 22, in substantially equal parts. Accordingly, speed and external conditions being equal, the force acting on the arms 83 is substantially halved relative to the known art, since the remaining half acts on the waist 85.

The towing equipment 1 is useful for allowing also a less trained or less strong person 8 to practice the sporting activity. In the case of a trained person, the latter can carry out the sporting activity with even greater satisfaction and better results, since said person has greater control and greater effective force available for maneuvering.

Moreover, the intensity of the physical effort required can be substantially reduced and therefore the on-water stay and endurance time of the water skier may be longer.

The distribution of forces between arms 83 and waist 85 (or midriff region) may reduce strains on the back, reducing tiring and the risk of pains and injuries.

Moreover, the towing equipment 1 is useful for improving the distribution of towing force: the force acting on the waist 85 is near the centre of gravity of the skier 8, i.e. about one-half of the overall towing force acts at a central region of the body (i.e., at the waist 85). This can allow the skier 8 to more easily keep a balanced position and therefore perform complex maneuvers and evolutions with less difficulty.

According to the shown embodiment, the first flexible branch 21 and the second flexible branch 22 are joined to each other and are shaped as a continuous flexible body, i.e. their distal ends 212, 222 match, forming a continuous piece of rope.

In other words, in the example, the two flexible branches 21, 22 are consecutive sections or segments of a same rope 23 folded with a C-like shape; in case the flexible branches 21, 22 comprise plural ropes joined each other in sequence (as shown in FIG. 1 for the second flexible branch 22), at least their distal portions are consecutive sections or segments of the same rope 23.

In order to keep said C-like folded shape, the junction region 30 of the towing equipment 1 comprises a return member 31 around which the continuous flexible body (and in particular said rope 23) goes around; in other words, the continuous flexible body (and the rope 23) is arranged astride the return member 31, so as to be folded with a C-like shape, in which a first wing of the C-shape is a part of the first flexible branch 21 and a second wing of the C-shape is a part of the second flexible branch 22. The junction region 30 is Y-shaped.

For instance, the continuous flexible body has an overall length (equal to the sum of the lengths of the two flexible branches 21, 22) of 2.5 metres (m). Of course, other length values (e.g., of 3 m or more) are possible; the overall length will be selected on a case-by-case basis according to specific needs.

In particular, the return member 31 includes a seat 37 for mounting the continuous flexible body (and the rope 23), which can slide in said seat: thus, the rope 23 moves relative to the return member 31 and a lengthening of the first flexible branch 21 corresponds to a shortening (for a segment of equal length) of the second flexible branch 22, whereas a lengthening of the second flexible branch 22 corresponds to a shortening (for a segment of equal length) of the first flexible branch 21.

Therefore, the towing equipment 1 can be configured to follow the motions of the skier 8, to keep both flexible branches 21, 22 always taut and to equally distribute forces between the two branches 21, 22 (and therefore between arms 83 and waist 85) for each angle of tilt of the skier 8.

In the example, the return member 31 comprises a pulley 33 which is pivoted to a support frame 35 (e.g. having a flattened ring shape) and can therefore rotate around an axis 330. The continuous flexible body or rope 23 is arranged astride the pulley 33, i.e. is arranged around it as in a sheave. Therefore, the sliding of the rope 23 relative to the return member 31 corresponds to a rotation of the pulley 33 around the axis 330; this makes such sliding very smooth and with low friction. The concomitant variation of distances between handle 25 and return member 31, and between skiers waist 85 and return member 31 is smoother.

Basically, the return member 31 is a simple block.

Figure 3:
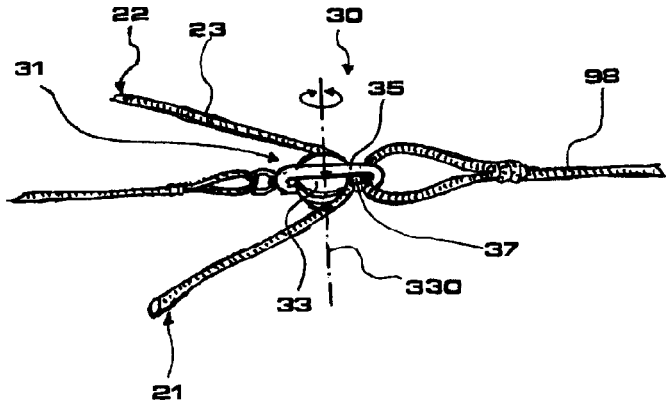
FIG. 3 shows an enlarged perspective view of a detail of the towing equipment according to FIG. 1.
Figure 4:
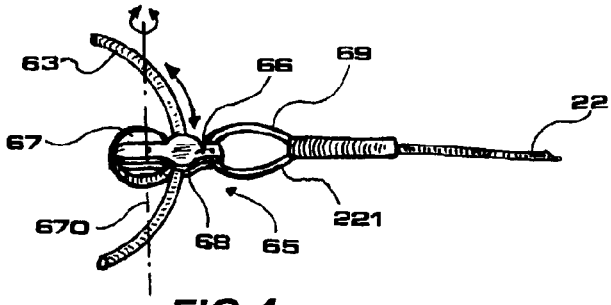
FIG. 4 shows an enlarged perspective view of a detail of the towing equipment according to FIG. 1.

In the example, the rope or line 98 is fastened to the return member 31 in order to connect the towing equipment 1 to the motor boat 9. According to the embodiment shown in detail in FIG. 3, the continuous flexible body 23 and the line 98 are both arranged across said seat 37, which is a through recess of the return member 31, so as not to interfere with each other; in said through recess 37, the continuous flexible body 23 is interposed between the pulley 33 and the line 98.

The towing equipment 1 further comprises an automatic release device 4 for releasing a proximal end 221 of the second flexible branch 22 from a remaining part of the second flexible branch, i.e. for interrupting or breaking the physical continuity of the second flexible branch 22. Such automatic release device 4 is configured to be automatically actuated when the skier 8 has released the handle 25: the actuation of the automatic release device 4 interrupts the connection between the waist 85 of the skier 8 and the distal portion 12 of the towing equipment 1, aiming at completely disconnecting the skier 8 from the motor boat 9.

According to the shown embodiment, the automatic release device 4 is calibrated for releasing the proximal end 221 of the second flexible branch 22 when the length L22 of the latter is greater than a predetermined length L22*a*, or threshold length.

Since, as mentioned, the first flexible branch 21 and the second flexible branch 22 are parts of a single continuous flexible body having a predetermined total length and slidably mounted on the return member 31, a length L22 greater than the threshold length L22*a* implies that the length L21 of the first flexible branch 21 has shortened below a threshold length, i.e. that the handle 25 has been released by the skier 8.

The actuation of the automatic release device 4 causes the separation of the second flexible branch 22 into two sections or segments 22*a*, 22*b* that are no more continuous to each other. Thus, there is no transmission of towing force anymore: a first section 22*a* stays associated with the waist 85 of the skier 8, a second section 22*b* stays associated, by means of the return member 31 and the line 98, to the motor boat 9 and goes on therewith. Following this separation, the skier 8 is in no way connected anymore to the motor boat 9.

According to the shown embodiment, the automatic release device 4 is mounted on the second flexible branch 22 and is interposed between said first section 22*a* and said second section 22*b* of the second flexible branch 22. The automatic release device 4 is connected to an actuating cord 45 that, when pulled, actuates the device 4 causing the release of the first section 22*a* from the second section 22*b*.

In the example, the actuating cord 45 extends between the automatic release device 4 and the distal portion 12 or the junction region 30; in particular, it is fastened to an actuation lever 44 for actuating the automatic release device 4, and to the support frame 35 of the return member 31.

The actuating cord 45 has such a length L45 that the actuating cord 45 is slack and non-tensioned when the length L22 of the second flexible branch 22 is lesser than the threshold length L22*a*. In this condition, the distance D4 between the automatic release device 4 and the support frame 35 is lesser than the length L45 of the actuating cord 45.

When, following a release of the handle 25, the rope 23 slides relative to the return member 31, the second flexible branch 22 lengthens and the first flexible branch 21 shortens; the distance D4 increases until the length L22 reaches the threshold value L22*a*. In such a condition the distance D4 is equal to the length L45 of the actuating cord 45, which therefore is tensioned and passes from a slack condition to a taut condition.

A further sliding of the rope 23 causes a pull on the actuating cord 45, which snaps and actuates the automatic release device 4.

Therefore, the actuating cord 45 is slack when the length L22 of the second flexible branch 22 is lesser than the predetermined length L22*a*, and is taut when the length L22 of the second flexible branch 22 is greater than the predetermined length L22*a*; in the second condition the automatic release device 4 is actuated, causing the breaking of the second flexible branch 22.

It should be noted that the actuating cord 45 is required to be associated with the second section 22*b* which departs from the skier 8; in fact, the actuating cord 45 itself, were it associated with the first section 22*a*, would act as connection between the support frame 35 and the skier 8, preventing a complete releasing of the latter from the motor boat 9.

It is, however, understood that other embodiments are possible: e.g., the automatic release device 4 might be mounted on the first flexible branch 21 for releasing a proximal end 211 of the first flexible branch 21 from a remaining part of the first flexible branch 21; the actuating cord 45 might be fastened to the abdominal belt 6 and to the automatic release device 4 at the side facing the handle 25: in this case, the breaking of the first flexible branch 21 following the release of the handle 25 would cause the detachment of the handle 25 from the distal portion of the first flexible branch 21 and the complete escaping of the rope 23 from the return member 31, causing a complete releasing of the skier 8 from the motor boat 9.

Figure 5:
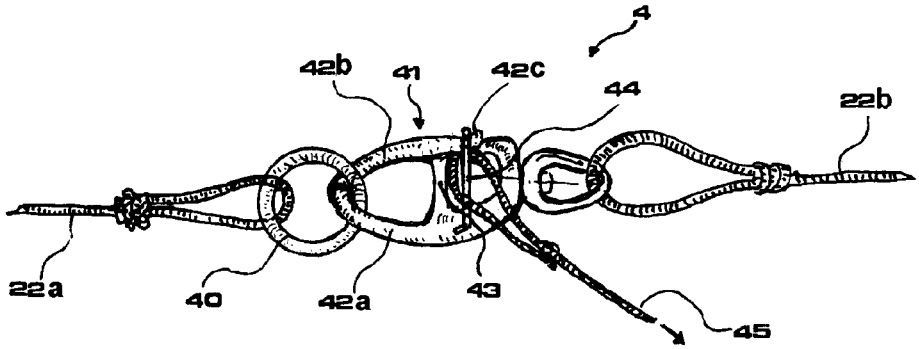
FIG. 5 shows an enlarged perspective view of an embodiment of a component of the towing equipment according to FIG. 1, in a first condition.
Figure 6:
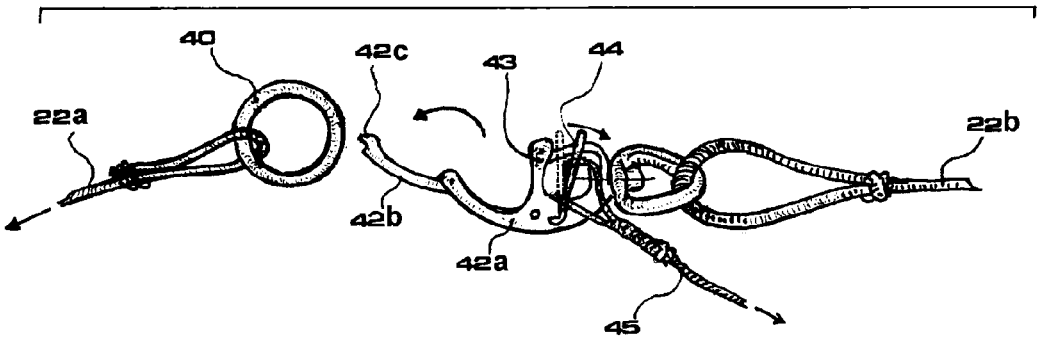
FIG. 6 shows a perspective view of the component according to FIG. 5, in a second condition.
Figure 7:
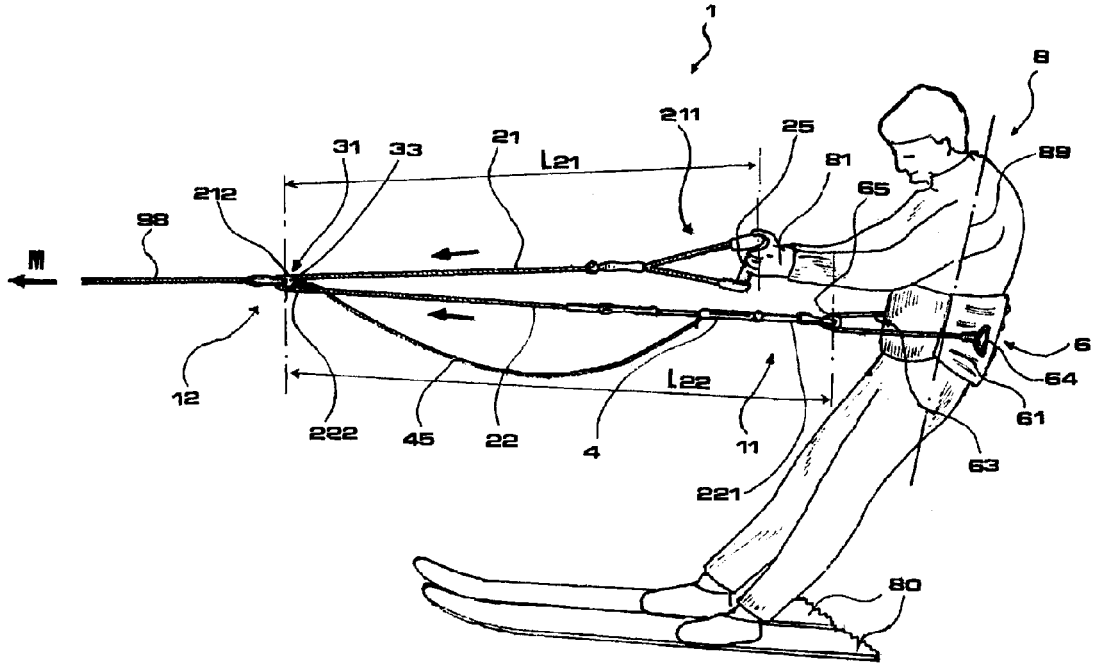
FIG. 7 shows a schematic side view of a step of use of a towing equipment according to the present disclosure.
Figure 8:
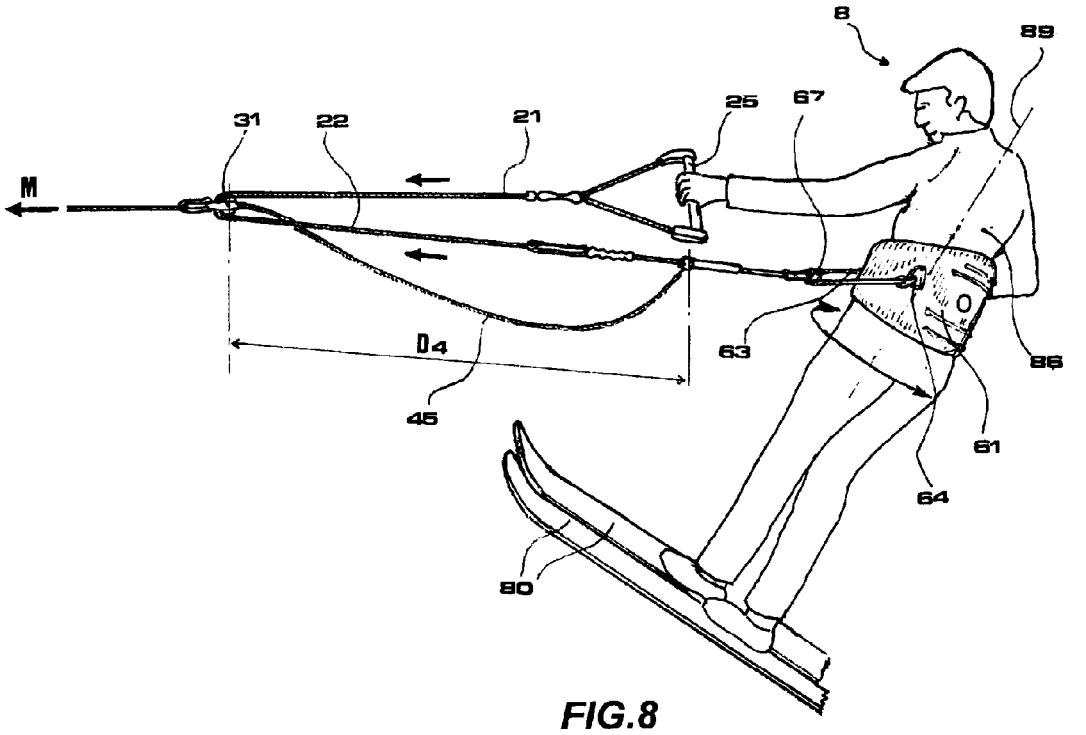
FIG. 8 shows a schematic side view of another step of use of a towing equipment according to the present disclosure.
Figure 9:
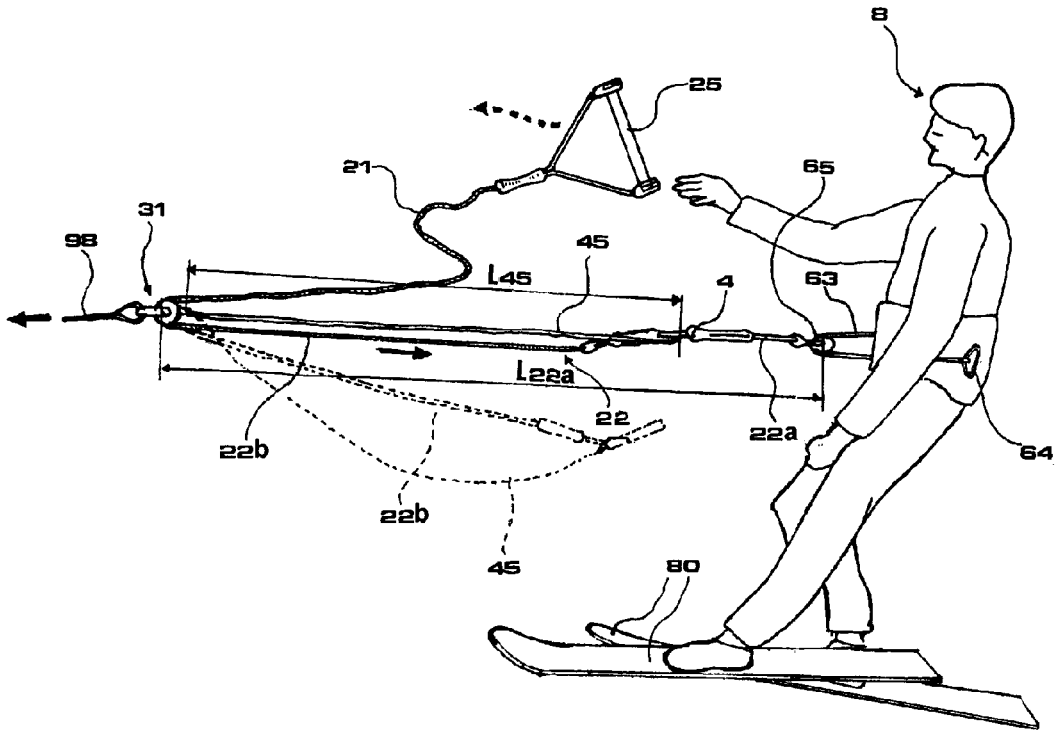
FIG. 9 shows a schematic side view of yet another step of use of a towing equipment according to the present disclosure.
Figure 10:
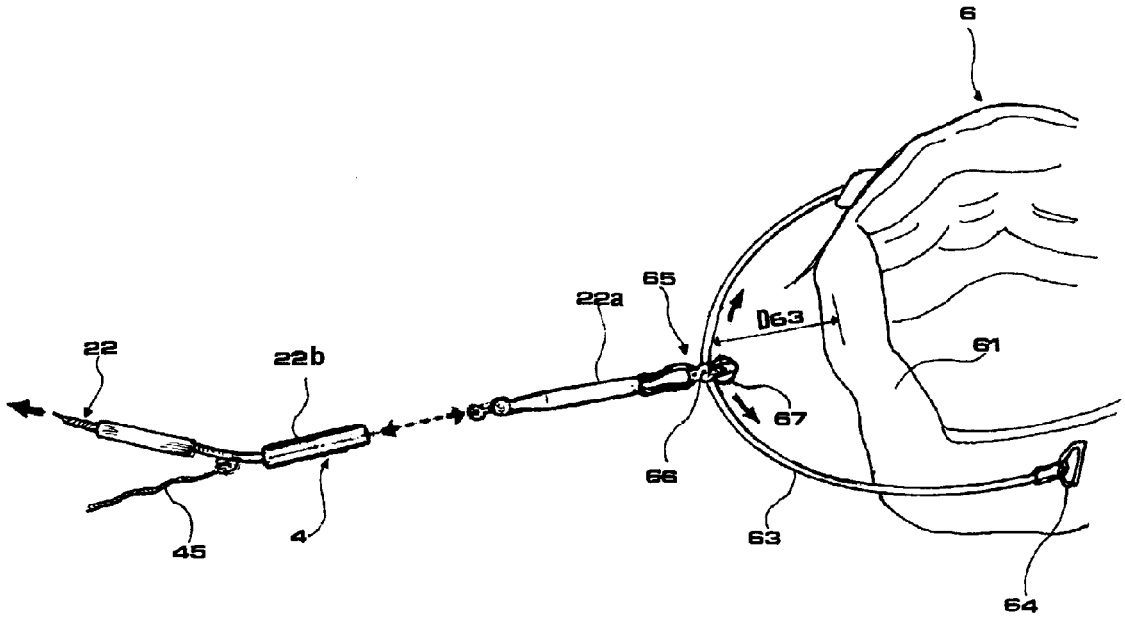
FIG. 10 shows an enlarged view of a detail of the towing equipment according to FIG. 1 in a step of use.
Figure 11:
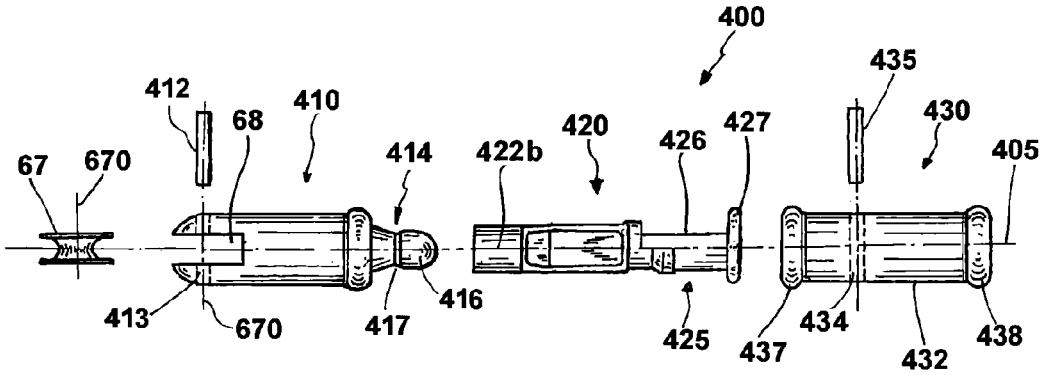
FIG. 11 shows an exploded side view of another embodiment of a component of a towing equipment according to the present disclosure.
Figure 12:
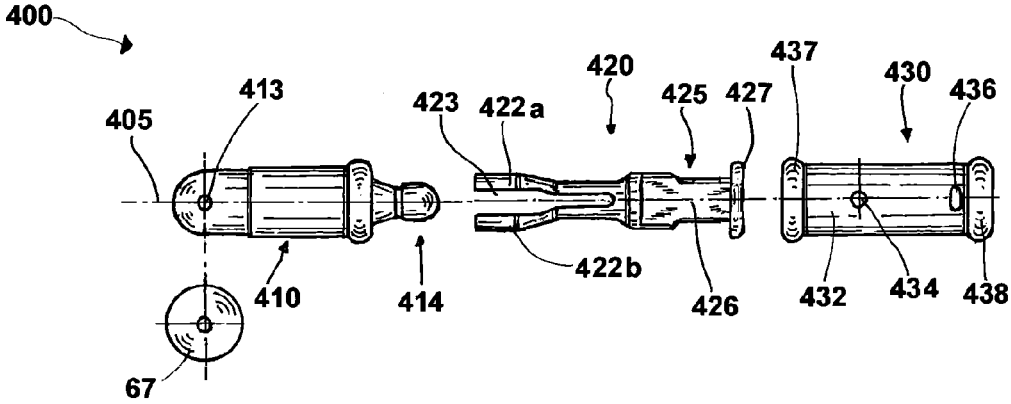
FIG. 12 shows an exploded top view of the component according to FIG. 11.
Figure 13:
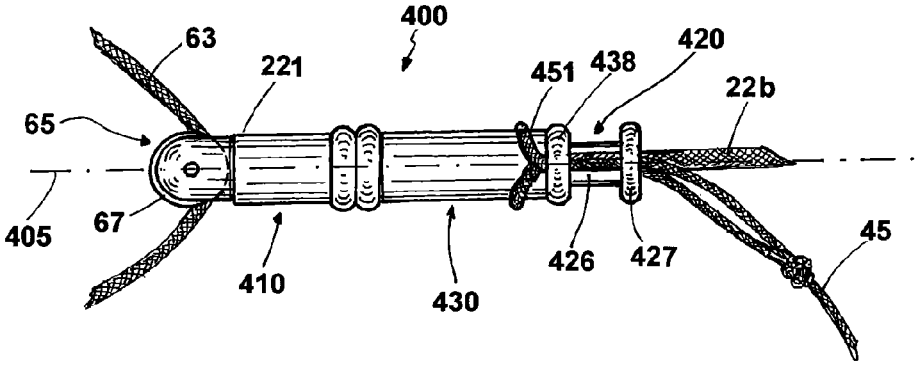
FIG. 13 shows a top view of the component according to FIG. 11, in a first condition.

The operation principle of such automatic release device 4 is basically illustrated in FIGS. 5 and 6 with reference to another example of automatic release device 4, which may be employed likewise for a towing equipment 1 according to the present disclosure. The present inventor has adapted a snap shackle by Wichard Company (and subject-matter of U.S. Pat. No. 4,279,062) to work as an automatic release device 4 for the present purpose.

The automatic release device 4 comprises a substantially ring-shaped member 41 formed by two half-rings 42*a*, 42*b* pivoted to each other at a first end. The second end of the first half-ring 42*a* is integral to a body 43 of the automatic release device 4. A lever or small hook 44 is pivoted to said body 43; the actuating cord 45 is fastened to the hook 44. Moreover, the second section 22*b* of the second flexible branch 22 is fastened to the body 43.

In a closed condition, the second half-ring 42*b* is kept locked on the body 43 by the hook 44, which is received in a seat against a tooth 42*c* of the second end of the second half-ring 42*b*. In this condition, the two half-rings 42*a*, 42*b* form a closed ring 41 which can hold a small ring 40 to which the first section 22*a* of the second flexible branch 22 is fastened. Therefore, when the ring 41 is in a closed condition, physical continuity is kept between the first section 22*a* and the second section 22*b*, and traction forces can be transmitted between each other: the second branch 22 behaves as if it were a single rope.

Pulling the actuating cord 45 with a suitable force causes a partial rotation of the hook 44 in a direction away from the first ends of the two half-rings 42*a*, 42*b*, and the disengagement of the hook 44 from the tooth 42*c*. The second half-ring 42*b* is thus free and it rotates under the force exerted by the small ring 40; the ring 41 becomes open and allows the slipping off of the small ring 40. The first section 22*a* and the second section 22*b* are thus separated and made independent from each other.

It should be taken into account that other automatic release devices having similar operation may likewise be adopted.

As anticipated hereto, the proximal end 221 of the second flexible branch 22 can be associated with the waist 85 of the skier 8 with different modes.

The example described hereinafter provides the use of an abdominal belt 6.

The abdominal belt 6 comprises a band or harness 61 for encircling the waist 85 of the skier 8 to ensure a stable connection between the abdominal belt 6 and the skier 8. Such a band 61 can be opened and is adjustable to adapt to the waist measure of the skier 8. The band 61 is substantially a trapeze, which may find application in other sports, like e.g. kitesurfing.

The abdominal belt 6 further comprises a guide element 63, which is fastened to the band 61 and extends between one side and the other side of the band 61 (and therefore between the hips of the skier 8 wearing it) and in front of the abdomen, i.e. in a front region in front of the belly of the skier 8. Basically, the guide element 63 is interposed between the skier 8 and the second flexible branch 22 of the towing equipment 1.

In the example, the guide element 63 is shaped like a half-circle.

For instance, the guide element 63 is fastened to the band 61 by circle- or triangle-shaped hooks or rings 64, which in turn are fastened to the band 61 at the sides thereof. As an example, the fastening of the guide element 63 on the band 61 is removable at least at one side, so that the guide element 63 can be inserted in a connecting member 65, as it will be made evident hereinafter.

The guide element 63 in the example has an elongated shape and is a piece of cable or rope made of or coated with a plastic material having a low friction coefficient. For instance, the guide element 63 is a piece of rope made of polypropylene or Dyneema®, coated with a polyurethane cladding or sheath; the diameter of the guide element 63 is comprised, e.g., between 6 mm and 8 mm.

Moreover, the guide element 63 has a length greater than the portion of band 61 that it spans or encircles, and its central region is spaced apart from the band 61; for instance, in the central region in front of the belly, the guide element 63 has a distance D63 from the band 61 which is comprised between 10 and 15 cm, for example 10 cm.

The guide element 63 might also be arranged past the sides, toward the back, i.e., it might encircle a greater portion of band 61; in the example, it extends so as to be at least at the abdomen region and part of the sides.

Should there be a need for the skier 8 during the towing to turn his/her back to the motor boat 9, the guide element 63 may have a greater length and be arranged and extend also in the back region; for this purpose it may be envisaged to fasten the rings 64 to the band 61 in locations corresponding to regions immediately at the sides of the spine of the skier 8.

The second flexible branch 22 comprises a connecting member 65 for connecting the second flexible branch 22 to the abdominal belt 6 and, in particular in the present example, to the guide element 63. The connecting member 65 can slide along the abdominal belt 6.

The guide element 63 is engaged by the connecting member 65, which in particular is fastened at the proximal end 221 of the second flexible branch 22, and the connecting member 65 can slide along the guide element 63.

According to the shown embodiment, the connecting member 65 comprises a frame 66 having a C-like or ring-like shape, and a wheel or pulley 67 which is pivoted to the frame 66 and can rotate around an axis of rotation 670.

The frame 66 and the wheel 67 define a through recess 68, on which the wheel 67 faces. The frame 66 further comprises means (e.g., a small ring 69) for fastening to the second flexible branch 22. Basically, the connecting member 65 is a simple block.

In particular, the wheel 67 is positioned between the guide element 63 and the band 61. The through recess 68 is configured for receiving and housing a portion of the abdominal belt 6 and in particular said guide element 63. In other words, the through recess 68 is a seat for said guide element 63.

According to some embodiments of the disclosure, the guide element 63 is inserted into the through recess 68 and then fastened to the band 61 at both sides, so that an undesired slipping off thereof from the recess 68 of the guide element 63 is prevented. When the second flexible branch 22 is pulled, the wheel 67 is in contact with the face of guide element 63 facing the abdominal band 61; in particular, the guide element 63 is received in a race of the wheel 67. The connecting member 65 is therefore mounted on the guide element 63 and can slide relative to the guide element 63.

Therefore, the connecting member 65 ensures a connection between the second flexible branch 22 and the waist 85 of the skier 8, and moreover the connecting member 65 can slide along the guide element 63 from one side to the other side of the skier 8 and vice versa. Such a sliding is accompanied by a rotation of the wheel 67 around the axis 670, allowing to reduce sliding friction and wear of the guide element 63.

An operation mode of a towing equipment 1 according to the present disclosure is described hereinafter.

The skier 8 wears the abdominal belt 6; the connecting member 65 is associated with the guide element 63. The distal portion 12 of the towing equipment 1, and in particular the return member 31, is connected to the motor boat 9 by the line 98.

The skier 8 grasps the handle 25 with the hands 81 and he/she is ready to start the towing and the sporting activity.

The motor boat 9 begins to move and, through the towing equipment 1, tows the skier 8; the skier 8 gains speed and skis skimming on the water surface 90. In particular, the skier 8 receives a towing force both to the arms 83 through the first flexible branch 21, and to the waist 85 through the second flexible branch 22; both flexible branches 21, 22 are pulled taut and the towing force is distributed roughly equally between them.

The actuating cord 45 is slack, because the length L22 of the second flexible branch 22 is lesser than the threshold value L22*a*.

By varying the force exerted on the handle 25 and the extension of the arms 83, the skier 8 can shorten or lengthen the length L21 of the first flexible branch 21 (and correspondingly lengthen or shorten the length L22 of the second flexible branch 22) and modify its tilt relative to the water surface 90, optionally carrying out evolutions or the like. The chosen threshold length L22*a* ensures that, during such variations of tilt, the length L22 of the second flexible branch 22 is below the threshold value L22*a*.

For instance, the length L45 of the actuating cord 45 is chosen for the actuating cord 45 to be tensioned when the difference between the length L22 of the second flexible branch 22 and the length L21 of the first flexible branch 21 is about 75 cm.

During the evolutions, the skier 8 can rotate the torso 86 (or even the entire body) directing a hip, instead of the belly, to the towing motor boat 9. During rotation of the torso 86, the connecting member 65 slides along the guide element 63 and moves to the side facing the motor boat 9. If required, as already described in the foregoing, the guide element 63 may be longer and fastened in the back region: thus, the skier 8 may rotate until directing the back to the motor boat 9, with a corresponding displacement of the connecting member 65.

Thanks to the sliding of the connecting member 65 along the guide element 63, the point of application of the towing force exerted by the second flexible branch 22 on the skier 8 shifts and stays on a fictitious line joining the junction region 30 with a barycentric vertical axis 89 of the person 8.

Thus, the towing direction can be always aligned with the towing vehicle 9 and with the person 8, regardless of the motions of the person and of how much said person has rotated the torso; this is useful not to disturb the chosen position of the person, in order to ensure maximum comfort during the sporting activity.

On the contrary, were the proximal end 221 statically fastened on the abdominal belt 6 at the belly, the second flexible branch 22 would not be aligned with the barycentric axis 89 when the person 8 turns a hip to the motor boat 9; the second flexible branch 22 would therefore exert a torque which would tend to rotate the torso 86 of the person 8, returning the belly to face the motor boat 9. This would be a disturbance of the position of the skier 8: such a disturbance herein is prevented by providing a sliding connection between the second flexible branch 22 and the waist 85 of the person 8.

When the person 8 releases the handle 25 (owing to tiredness or loss of control), the continuous flexible body 23 composed by the two flexible branches 21, 22 slides relative to the return member 31: in fact, by virtue of the sliding connection between the continuous flexible body 23 and the pulley 33, the lack of drag force exerted by the skier 8 on the first flexible branch 21 causes the latter to slide on the return member 31; the shortening of the first flexible branch 21, due to sliding on the return member 31, corresponds to a lengthening of the second flexible branch 22. In this step, basically, the skier 8 moves away from the motor boat 9 for a distance corresponding to the lengthening of the second flexible branch 22.

When the length L22 of the second flexible branch 22 reaches the threshold value L22*a*, tensioning of the actuating cord 45 and actuation of the automatic release device 4 occur; said actuation breaks the second flexible branch 22 and completely releases the skier 8 from the connection with the motor boat 9; this ends the towing action. Basically, the automatic release device 4 allows to release the connection between the waist 85 of the skier 8 and the distal portion 12 of the towing equipment 1 when the skier 8 has released the handle 25.

This is useful for safety, in order to prevent the skier 8 from being further dragged by the motor boat 9 in a way uncontrolled and potentially dangerous for his/her physical safety.

For this purpose, it is advisable that the length L45 of the actuating cord 45 be selected so that the latter be tensioned before the sliding of the first flexible branch 21 brings the handle 25 to lock against the return member 31.

At the same time, the length L45 of the actuating cord 45 should be sufficiently long to give the skier 8 a sufficient maneuvering space for carrying out the sporting activity and evolutions.

An alternative embodiment of an automatic release device is shown in FIGS. 11 to 15, where it is denoted by reference number 400. The automatic release device 400 has an end portion including the connecting member 65.

The automatic release device 400 comprises a first member 410, a second member 420 and a third member 430. The first, second and third members are aligned along a longitudinal axis 405.

A wheel or pulley 67 is pivoted at a first end of the first member 410 through a first pin 412 received in a through hole 413 of the first member 410. Therefore, the wheel 67 can rotate around an axis of rotation 670. The first member 410 and the wheel 67 define a seat or through recess 68, on which the wheel 67 faces. The through recess 68 is configured for receiving and housing a portion of the abdominal belt 6 and in particular the guide element 63, as already described for the previous embodiment. The guide element 63 can slide relative to the through recess 68.

A second end of the first member 410 includes a projection 414, which has a projecting cap 416 and a narrower stem 417. In other words, the projection 414 is mushroom-shaped.

A first end of the second member 420 comprises two prongs 422*a*, 422*b* defining a seat or slit 423 between them. The prongs 422*a*, 422*b* are flexible or movable toward each other. When the prongs 422*a*, 422*b* are closer to each other, the seat 423 between the prongs 422*a*, 422*b* has a shape substantially complementary to the mushroom-shaped projection 414. In other words, the prongs 422*a*, 422*b* are configured to grasp the mushroom-shaped projection 414 and to hold the latter in order to make a connection between the first member 410 and the second member 420.

A second end of the second member 420 has a portion 425 having a channel 426 and a holed collar 427 with a longitudinal hole.

The third member 430 comprises a tubular body 432 defining a longitudinal housing which is open at both ends. The tubular body 432 is substantially cylindrical.

According to the shown embodiment, a transversal through hole 434 is provided in an intermediate region of the tubular body 432 and a second pin 435 is dimensioned for insertion into the transversal through hole 434.

A slot 436 is provided near a distal end of the tubular body 432. The tubular body 432 has respective end collars 437, 438.

When the automatic release device 400 is assembled, the second member 420 is inserted in the longitudinal housing of the third member 430, i.e. the second member 420 is housed within the tubular body 432. The second member 420 can slide within the third member 430. The second pin 435 is transversally received in the seat 423; the second pin 435 limits mutual movements (in particular, a rotational movement) between the second member 420 and the third member 430.

The length of the second member 420 is greater than the length of the third member 430, thus the second member 420 protrudes from the tubular body 432.

The second section 22*b* of the second flexible branch 22 is fastened to the second member 420; for example, an end of the second section 22*b* goes through the longitudinal hole of the holed collar 427 and it is fastened at the channeled portion 425.

The actuating cord 45 is fastened to the third member 430; for example, the actuating cord 45 goes through the longitudinal hole of the holed collar 427, is received in the channel 426, emerges through the slot 436, and makes a loop 451 around the tubular body 432.

In other words, the first member 410 is associated with the proximal end 221 of the second flexible branch 22, the second member 420 is associated with the remaining part 22*b* of the second flexible branch 22, and the third member 430 is associated with the actuating cord 45.

The internal dimensions of the longitudinal housing of the tubular body 432 are such that, when the third member 430 is displaced towards the first end of the second member 420 (FIG. 13), the prongs 422*a*, 422*b* are pushed to each other, i.e. they are closer to each other. The third member 430 is in a locking condition.

In this locking condition, when the mushroom-shaped projection 414 of the first member 410 is within the seat 423, the prongs 422*a*, 422*b* hold the mushroom-shaped projection 414; thus, the second member 420 is connected to the first member 410 and the traction forces exerted by the second flexible branch 22 are transmitted to the user 8.

Figure 14:
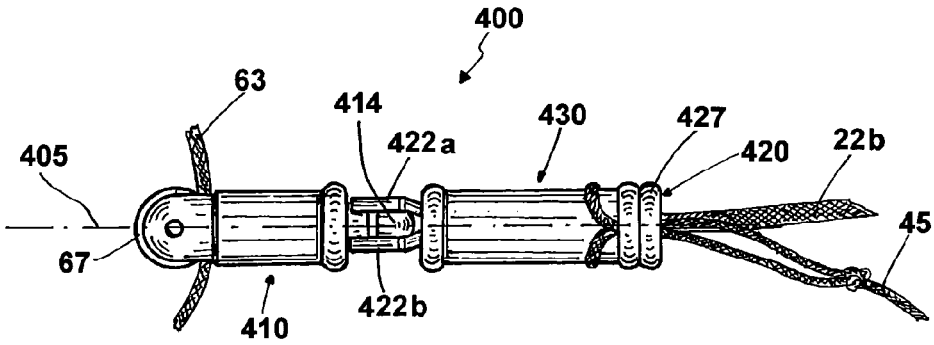
FIG. 14 shows a top view of the component according to FIG. 11, in a second condition.

Pulling the actuating cord 45 with a suitable force causes the third member 430 to be displaced along the longitudinal axis 405 towards the holed collar 427 of the second member 420 (FIG. 14). A maximum displacement is obtained when the end collar 438 of the third member 430 abuts against the holed collar 427 of the second member 420; the third member 430 is in a releasing condition.

In this releasing condition, the prongs 422*a*, 422*b* protrude from the tubular body 432 and then they are no more constrained to be closer to each other. The prongs 422*a*, 422*b* open out and widen the seat 423, which releases the mushroom-shaped projection 414. The opening of the prongs 422*a*, 422*b* is favored by elasticity of the prongs 422*a*, 422*b* and by a spreading action exerted by the mushroom-shaped projection 414.

When the third member 430 is displaced towards the releasing condition, the second pin 435 slides along the slit 423 between the prongs 422*a*, 422*b* and, thanks to the shape of the slit 423 narrowing towards the channeled portion 425, the second pin 435 helps the prongs 422*a*, 422*b* to open out.

Figure 15:
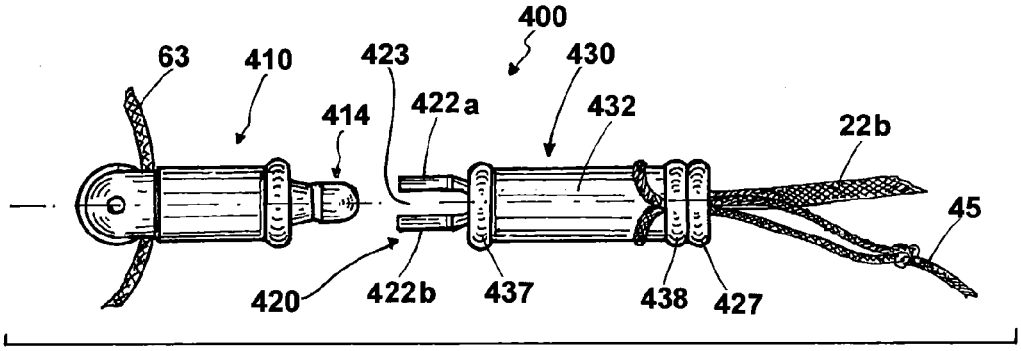
FIG. 15 shows a top view of the component according to FIG. 11, in a third condition.

The second member 420 is no more connected to the first member 410 and separation between them occurs (FIG. 15). The second flexible branch 22, which comprises also the automatic release device 400, is broken and no towing force is transmitted to the user 8 anymore.

The automatic release device 400 can be useful in cases where the pulling action of the actuating cord 45 and the movement of the third member 430 between the locking position and the releasing position are preferred to be along the direction of the second flexible branch 22.

In other words, the second flexible branch 22 is coaxial with the tubular body 432: the second section 22*b* is along the longitudinal axis 405 of the automatic release device 400. Also the actuating cord 45, at least between the end collar 438 of the third member 430 and the holed collar 427 of the second member 420, is along the longitudinal axis 405, which corresponds to the displacement direction of the third member 430.

Therefore, because the towing force by the second flexible branch 22 and the actuating force by the actuating cord 45 have the same direction, the operation of the automatic release device 400 can be simpler and safer, and it may be ensured even when the person 8 has lost control or has fallen, or when the actuating cord 45 and the second flexible branch 22 are partially twisted.

In the present example, the mushroom-like shape of the projection 414 and the corresponding shape of the seat 423 defined by the prongs 422*a*, 422*b* have revolution surface around the longitudinal axis 405. This may allow a mutual rotation of the second member 420 relative to the first member 410 around the longitudinal axis 405, in order to avoid transmission of torsion forces between them.

It should be noted that the transversal through hole 434 and the corresponding second pin 435 are optional features, that may be missing in alternative embodiments. For example, a rotational movement between the second member 420 and the third member 430 may be prevented by a tooth-and-channel arrangement.

The prongs 422*a*, 422*b* may be more than two; for example three or four prongs arranged on a substantially cylindrical surface may be provided.

The subject-matter of the present disclosure has been hereto described with reference to example embodiments thereof. It is understood that other embodiments might exist, all comprised within the protective scope of the claims hereinafter.

However, it is evident that each embodiment of the subject of the present disclosure may have one or more of the advantages discussed above; in any case, however, it is not required for each embodiment to concomitantly have all of the advantages discussed above.

The invention claimed is:

1. A towing equipment comprising a proximal portion intended to be associated with a person;

a distal portion intended to be connected to a vehicle; and a junction region, comprising a return member, interposed between the proximal portion and the distal portion, wherein the proximal portion includes a first flexible branch and a second flexible branch, which are connected to the distal portion at the junction region, wherein the first flexible branch and the second flexible branch are joined to each other and shaped as a continuous flexible body astride said return member, the return member including a seat for mounting the continuous flexible body, the continuous flexible body being slidable in said seat, and wherein a proximal end of said first flexible branch comprises a handle and a proximal end of said second flexible branch comprises a connecting member which is configured to be connected with the waist of said person, the towing equipment being intended for towing said person by said vehicle, the towing equipment further comprising an automatic release device configured to release the connection between the waist of the person and the distal portion of the towing equipment while the vehicle is exerting a pulling force on said distal portion, the automatic release device being further configured to be automatically actuated when the person has released the handle.

2. The towing equipment according to claim 1, further comprising an abdominal belt, the connecting member being configured to connect said proximal end of said second flexible branch with said abdominal belt.

3. The towing equipment according to claim 1, wherein the return member comprises a pulley pivoted to a frame, the continuous flexible body being arranged around said pulley.

4. The towing equipment according to claim 1, wherein the automatic release device is configured to release a proximal end of the second flexible branch from a remaining part of the second flexible branch.

5. The towing equipment according to claim 4, wherein the automatic release device is calibrated to release said proximal end of the second flexible branch when a length of the second flexible branch is greater than a predetermined length of the second flexible branch and the length of the first flexible branch is at the same time less than a predetermined length of the first flexible branch.

6. The towing equipment according to claim 5, wherein the automatic release device is mounted on the second flexible branch and is connected to an actuating cord extending between the automatic release device and the distal portion of the towing equipment, said actuating cord being slack when the length of the second flexible branch is lesser than said predetermined length, and being taut when the length of the second flexible branch is greater than said predetermined length.

7. The towing equipment according to claim 1, wherein said first flexible branch and said second flexible branch comprise ropes.

8. The towing equipment according to claim 1, further comprising an abdominal belt, the connecting member connecting the second flexible branch to the abdominal belt, wherein the connecting member can slide along the abdominal belt.

9. The towing equipment according to claim 8, wherein said connecting member comprises a frame and a wheel pivoted to said frame, wherein the frame and the wheel define a through recess for receiving a portion of said abdominal belt.

10. The towing equipment according to claim 8, wherein the abdominal belt includes a band for encircling the waist of a person and a guide element fastened to said band, wherein the guide element extends between one side and the other side of said band, the connecting member being mounted on the guide element.

11. The towing equipment according to claim 8, wherein the automatic release device is configured to release a proximal end of the second flexible branch from a remaining part of the second flexible branch, wherein the connecting member is an end portion of the automatic release device.

12. The towing equipment according to claim 6, wherein the automatic release device comprises a first member associated with the proximal end of the second flexible branch, a second member associated with the remaining part of the second flexible branch, and a third member associated with the actuating cord, wherein the third member is movable between a locking position and a releasing position, the movement of the third member being along the second flexible branch.

13. The towing equipment according to claim 12, wherein the third member comprises a tubular body, the second member being housed in the tubular body and the second flexible branch being coaxial with the tubular body.

14. A method comprising the steps of:

providing a towing equipment comprising a proximal portion, a distal portion and a junction region interposed between the proximal portion and the distal portion, wherein the proximal portion includes a first flexible branch and a second flexible branch, which are connected to the distal portion at the junction region, and wherein the proximal end of said first flexible branch comprises a handle, and wherein the junction region includes a return member, wherein the first flexible branch and the second flexible branch are joined to each other and shaped as a continuous flexible body astride said return member, the return member including a seat for mounting the continuous flexible body, the continuous flexible body being slidable in said seat;

connecting said distal portion to a vehicle;

connecting a proximal end of the second flexible branch with the waist of a person, the second flexible branch comprising a connecting member, setting up a connection between the waist of the person and the distal portion of the towing equipment;

associating said handle with the hands of the person; and releasing the connection between the waist of the person and the distal portion of the towing equipment when the person has released said handle while the vehicle is exerting a pulling force on said distal portion.

15. The method according to claim 14, wherein the proximal end of the second flexible branch can slide along the waist of the person, said proximal end being movable between one side and the other side of the person during a rotation of the torso of the person.

16. The method according to claim 14, wherein said person is a water skier and said vehicle is a motor boat.

17. A towing equipment comprising a proximal portion intended to be in communication with a person;

a distal portion intended to be connected to a vehicle;

a junction region interposed between the proximal portion and the distal portion, wherein the proximal portion includes a first flexible branch and a second flexible branch, which are connected to the distal portion at the junction region, wherein a proximal end of said first flexible branch comprises a handle and a proximal end of said second flexible branch is configured to be connected to the waist of said person, the towing equipment being intended for towing said person by said vehicle; and an automatic release device configured to release a proximal end of the second flexible branch from a remaining part of the second flexible branch, the automatic release device being calibrated to release said proximal end of the second flexible branch when a length of the second flexible branch is greater than a predetermined length, the automatic release device being mounted on the second flexible branch and is connected to an actuating cord extending between the automatic release device and the distal portion of the towing equipment, said actuating cord being slack when the length of the second flexible branch is lesser than said predetermined length, and being taut when the length of the second flexible branch is greater than said predetermined length, the automatic release device being configured to release the connection between the waist of the person and the distal portion of the towing equipment while the vehicle is exerting a pulling force on said distal portion, the automatic release device being further configured to be automatically actuated when the person has released the handle.

18. The towing equipment according to claim 17, wherein said first flexible branch and said second flexible branch comprise ropes.

19. The towing equipment according to claim 17, further comprising an abdominal belt and wherein the second flexible branch comprises a connecting member which is configured to connect the second flexible branch to the abdominal belt, wherein the connecting member can slide along the abdominal belt.

20. The towing equipment according to claim 19, wherein said connecting member comprises a frame and a wheel pivoted to said frame, wherein the frame and the wheel define a through recess shaped for receiving a portion of said abdominal belt.

21. The towing equipment according to claim 19, wherein the abdominal belt includes a band for encircling the waist of a person and a guide element fastened to said band, wherein the guide element extends between one side and the other side of said band, the connecting member being mounted on the guide element.

22. The towing equipment according to claim 19, wherein the connecting member is an end portion of the automatic release device.

23. The towing equipment according to claim 17, wherein the automatic release device comprises a first member associated with the proximal end of the second flexible branch, a second member associated with the remaining part of the second flexible branch, and a third member associated with the actuating cord, wherein the third member is movable between a locking position and a releasing position, the movement of the third member being along the second flexible branch.

24. The towing equipment according to claim 23, wherein the third member comprises a tubular body, the second member being housed in the tubular body and the second flexible branch being coaxial with the tubular body.

* * * * *